US006471101B1

(12) United States Patent
Vardanyan

(10) Patent No.: US 6,471,101 B1
(45) Date of Patent: Oct. 29, 2002

(54) SPOUT AND ITS ASSEMBLY WITH A RECEPTACLE

(76) Inventor: Gevorg Vardanyan, 412 N. Jackson St., #101, Glendale, CA (US) 91206

( * ) Notice: Subject to any disclaimer, the term of this patent is extended or adjusted under 35 U.S.C. 154(b) by 0 days.

(21) Appl. No.: 09/791,319

(22) Filed: Feb. 23, 2001

(51) Int. Cl.[7] ..... B67B 7/00

(52) U.S. Cl. ..... 222/541.2; 222/83; 222/534; 222/536

(58) Field of Search ..... 222/83, 533–536, 222/541.2

(56) References Cited

U.S. PATENT DOCUMENTS

| | | | | | |
|---|---|---|---|---|---|
| 2,109,483 | A | * | 3/1938 | Hothersall | 222/541.2 |
| 2,893,611 | A | * | 7/1959 | Akers | 222/536 |
| 3,653,546 | A | * | 4/1972 | Hazard | 222/83 |
| 4,416,395 | A | * | 11/1983 | Gaubert | 222/83 |
| 4,450,985 | A | * | 5/1984 | Beard | 222/541.2 |
| 4,475,670 | A | * | 10/1984 | Rutter | 222/83 |
| 4,602,725 | A | * | 7/1986 | Malpas et al. | 222/541.2 |

* cited by examiner

*Primary Examiner*—J. Casimer Jacyna
(74) *Attorney, Agent, or Firm*—Frank L. Zugelter

(57) ABSTRACT

A receptacle (20) having a pocket (29) in which a spout assembly (24) is stored prior to placing it in an open mode in which the receptacle's content is dispensed. Spout assembly (24) includes a spout proper (25) to which a body formation (27) having a chamber (39) in communication with spout proper 25 and by apertures (41) to receptacle (20). An arm (65) connects the spout proper (25) with a floor (37) of pocket (29). Floor (37) includes a frangible area (48) formed by scoring (49) and which is broken from floor (37) upon introducing a breaking member (47) into the frangible area (48). Body formation (27) includes breaking member (47). Body formation (27) also includes an endless peripheral flange (52) around it and from which an endless lug (54) depends. Endless lug (54) engages and seals the spout assembly (24) to the floor (37) upon placing in open mode spout assembly (24) to the receptacle floor (37) by removing spout assembly (24) from its stored position in pocket (29) and lifting it out of pocket (29) so that breaking member (47) breaks frangible portion (48) as lug (54) is tightly fitted to a groove (55) in floor (37). The content of receptacle (20) flows from its interior through apertures (41) into chamber (39) of body formation (27) and thence into spout proper (25) for discharge through its orifice, (33).

16 Claims, 3 Drawing Sheets

SPOUT AND ITS ASSEMBLY WITH A RECEPTACLE

TECHNICAL FIELD

This invention relates to receptacles and in particular to a novel spout for dispensing therethrough contents from a source such as from a receptacle, to its assembly in a novel lid, in the formation of a novel receptacle, and the novel spout.

BACKGROUND OF THE INVENTION

Present-day (usually metallic such as aluminum) receptacles for containing in their interiors liquids such as beverages include in each a thin finger member (or tab) flatly attached by a rivet to the top of a lid crimped to a circular wall of the receptacle or can. The rivet and tab seat within and to a very shallow recessed portion or area formed or punched in the lid. The tab includes generally two (2) sections one to each side of the rivet. A finger or its nail is applied to the end of a first section to leverage it against the rivet and its second section that then is caused to strike the recessed portion of the lid. The recessed portion is formed below the second section of the tab by a curvilinear scored band or line in its make-up so that in the levering action by the first section the striking by the second section against the recessed portion breaks the band or line from its formation in the recessed portion to produce an opening through which a content, such as a liquid, can be dispensed from within the can's chamber or interior. None of the second section drops freely into the can's interior, although a major portion of it is broken or severed, as a smaller portion of the second section includes a non-scored portion by which the second section is retained as an integral part of the lid. Should the first section of the tab be pushed back down against the lid, or should the tab completely separate from its attachment to the rivet, the first section or the tab is readily removed from the can's top without it falling through the opening into the can's interior.

This type of present-day receptacle, invariably but not exclusively utilized by the soft-drink, bottled water, alcoholic and ale/beer industries, does not include a convenient or efficacious bridging or spanning component to the mouth of a person drinking the liquid, as the person's bottom lip clutches the wall of the receptacle below its lid while the person's upper lip or remainder of the mouth grasps around the edges of the produced hole. Dripping and spillage of the content occurs in this manner of drinking from the can. Also, the receptacle's content being dispensed from the opening is not completely consumed by the drinking person who is seeking to draw all of the liquid being dispensed from the can lid's opening. Spillage, too, with possible damage to clothing and other objects in the vicinity may occur as a result of such manner of drinking.

Prior art teachings in the disclosures of U.S. Letters Pat. Nos. 3,385,501; 3,486,679; 4,251,019; 4,462,503; 4,709,829; 5,522,524; and 5,687,872 do not disclose the present invention.

SUMMARY OF THE INVENTION

The invention is directed to a uniquely designed spout assembly, its relationship or connection to a receptacle's wall or lid, and to the receptacle or can itself and in which receptacle the spout assembly is part of or stored until the receptacle is to switch or shift to its operable or open mode (position) from its closed mode (position). The receptacle's content, i.e., flowable substances, when in its open mode, is drawn from its interior into and through the spout assembly into one's mouth or to or for another end or purpose. The spout proper is formed in a truncated-pyramid-like design, having its mouth end of a smaller dimension than its other or distal end to which is attached a channeling body formation with communicating apertures and a member that breaks a frangible portion of the wall or lid in the step of shifting the spout assembly into its open mode to or with the receptacle. The channeling body formation directs through its apertures the can's content into the spout proper when the can is in its operable mode after the breaking member acts on the frangible portion. A recessed pocket having a floor is formed in the can's wall or lid and is sized to accept the spout assembly for storing it in the closed mode for the receptacle. The spout assembly in a turning or pivoting motion is elevated or lifted out of its stored position (closed mode) in its pocket by a pull on the spout's orifice or mouth end by a finger or other actuator, and during the turning or pivoting action the frangible portion is broken to provide an opening through which the body channeling formation drops or descends. A peripheral or annular or endless flange mounted around the channeling body formation seats the spout assembly on the floor or wall and prevents further descent of the spout assembly into the can's interior. An endless lug, spaced from the body formation, extends around the endless flange, depending therefrom, the flange supporting the lug which mates with an endless groove formed in the floor or wall. The groove and lug circumscribe or encompass the boundary of the opening made in the floor or wall by the action of the breaking member upon the frangible portion in the floor or wall. The cooperation or mating of lug and groove in the floor or wall provides a firm tight fit between the spout assembly and lid or wall, so that the receptacle's content flows into the spout proper from the channeling body formation without leakage or loss and which otherwise could occur through a loose or unattached seating of the spout assembly's flange to the floor. A flexible appendage, such as an arm, connects together the floor and spout assembly in the latter's stored position or closed mode of the invention. As the spout assembly is lifted out of the recessed pocket in its displacement towards an operable or open mode for the can, a small scored segment in the floor is caused to be detached by the pull of the spout. An air hole results in the floor for equalizing pressure between the interior of the receptacle and the surrounding ambient air as well as helping to open the floor's flangible portion.

An object of this invention is to provide a novel spout assembly in and of itself.

Another object of this invention is to provide a novel lid or wall to which the invention's spout assembly can be assembled.

A still further object of this invention is to provide for a novel can that includes the invention's spout assembly as an integral part of it.

Yet another object of this invention is to provide a novel receptacle or can to which a spout assembly interacts by connection therewith to produce a dispensing of content from the receptacle or can without waste or loss of any of the content.

A still further object of this invention is to provide an efficacious accommodation between the content being dispensed from a receptacle or can and its target to which the content is intended to reach, such as, for example, a liquid in a can to the mouth of one drinking from the can.

A further object of this invention is to provide an efficient and efficacious way to open a receptacle that then is ready immediately to dispense its content.

A still further object of the invention is to make drinking out of a can more pleasant and convenient.

Yet another object of this invention is to store a spout assembly in the confines of a receptacle itself.

These and other objects and advantages of the invention will become more apparent from a complete and full reading of the following description, its appended claims, and the accompanying drawing comprising three (3) sheets of ten (10) FIGURES.

BEST MODE OF CARRYING OUT THE INVENTION

Figure 1:
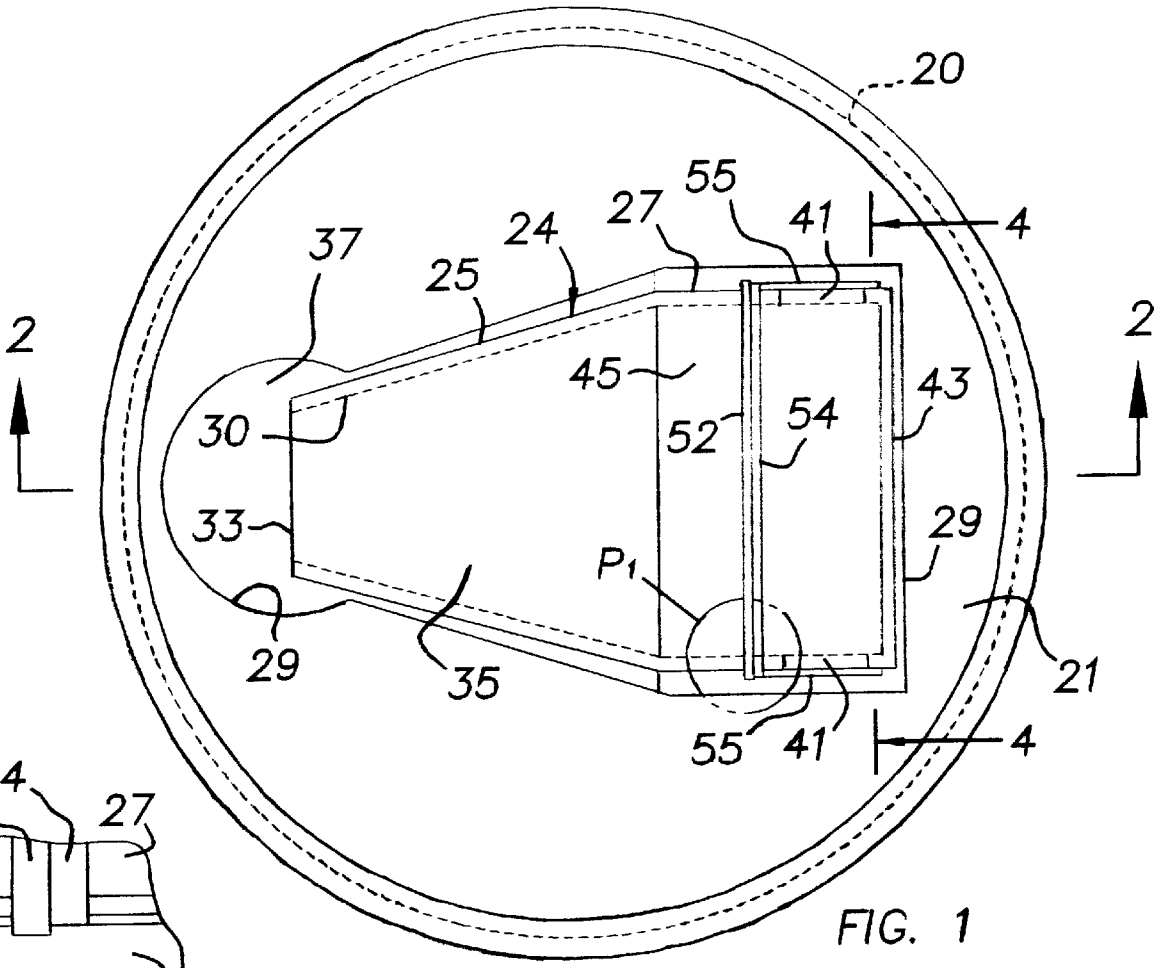
FIG. 1 is a plan view of the spout and receptacle in their assembled relationship in the closed mode of the invention.
Figure 2A:
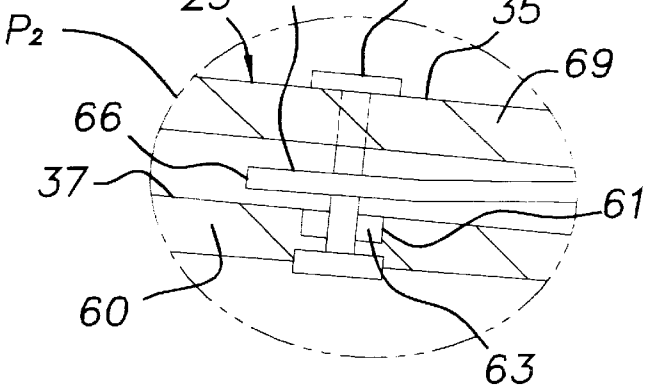
FIG. 2*a* is a fragmentary enlarged view of a portion enclosed by phantom-line P2 in FIG. 2
Figure 2:
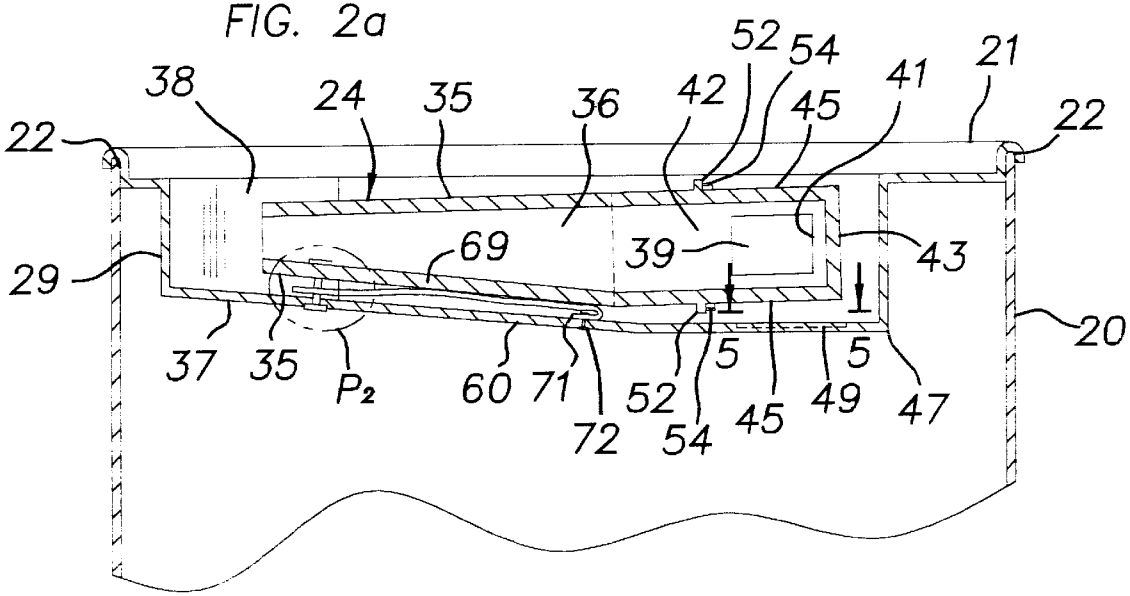
FIG. 2 is an elevational view taken on line 2—2 of FIG. 1.
Figure 3:
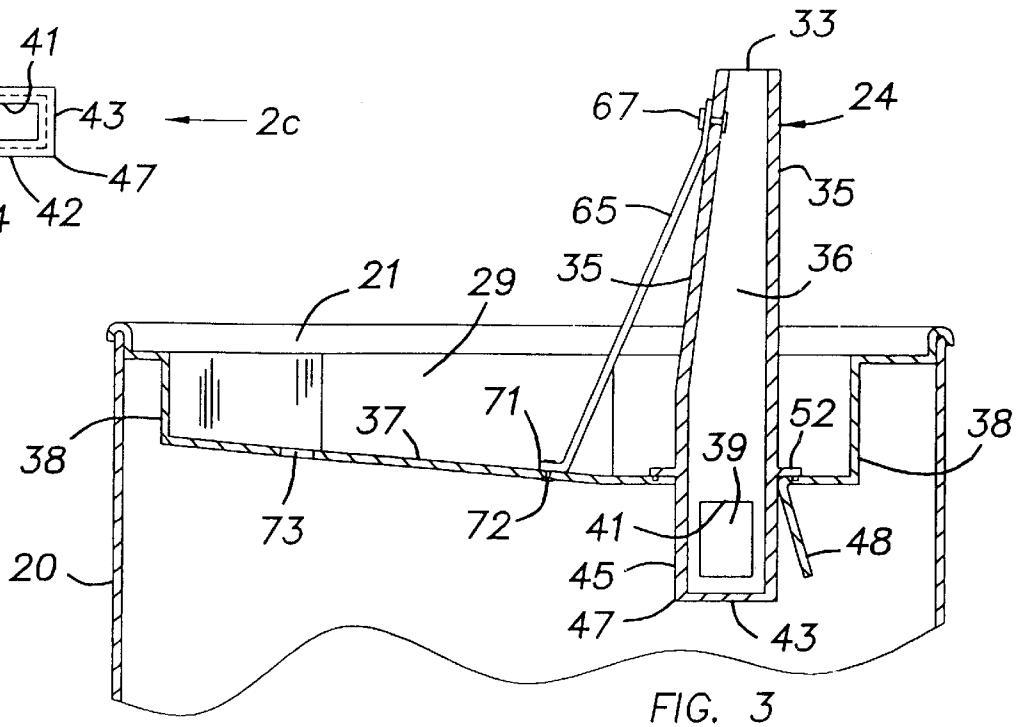
FIG. 3 is an elevational view, similar to that of FIG. 2, the spout assembly, however, being shown in its operational position or open mode for the invention.

Referring now to the drawing in which reference characters correspond to like numerals hereinafter, FIGS. 1, 2, and 3 illustrate a receptacle or can 20 of circular design although the invention is not limited to such a design. A lid 21 is conventionally crimped or sealed to it at its one open end 22, FIG. 2, and in which lid 21 a spout assembly 24 having a spout proper 25 and a lower body formation 27, FIG. 1, is disposed within a recessed pocket 29, FIG. 2, formed in lid 21. Spout proper 25 in the preferred embodiment takes the form of a tapering hollow member 30, illustrated in a general manner of a geometrical truncated pyramid having an orifice 33 at its smaller end. The formation of hollow member 30 in its illustrated form includes a pair of opposing lateral sides 35, FIGS. 1, 2, joined together by a second pair of opposing transverse sides 36, FIGS. 2, 2*b*, 2*d*, 3, the sides 35 being of greater areal dimensions than those of sides 36. One of sides 35 generally mirrors the planar dimension of a floor 37 that forms with an endless vertically-oriented wall 38, FIGS. 2, 3, the recessed pocket 29. The other one of sides 35 is disposed in a planar dimension in proximity to the plane of lid 21, FIG. 2, in the closed mode of the invention.

Body formation 27 forms a chamber 39 that is in communication with the hollowness of member 30 and in the operation of the invention with the interior of can 20. Body formation 27 is integrally formed with or attached to the spout proper 25 at the latter's larger end distal from its orifice 33, and includes, FIGS. 1, 2, 2*b*, 2*d*, 3, one or more apertures 41 in one or more sides 42 and a solid bottom wall 43. Body formation 27 functions as one or more channels for flow of content from can 20 into spout proper 25 in the operation of the invention. Its one set of opposing sides 45, FIGS. 1, 2, attach to or extend from corresponding ones of lateral sides 35 and its other set of opposing sides 42, FIGS. 2, 2*d*, attach to or extend from corresponding ones of transverse sides 36, with solid bottom wall 43 joining all of the sides 45 and 42. Bottom wall 43 and one of the opposing sides 45 form an edge 47, FIG. 3, that constitutes an effective forcing element or member that breaks through a frangible portion 48, FIG. 5, formed by the non-endless scoring as at 49, FIGS. 2, 5, in floor 37 of pocket 29 in the lid or wall 21 in the operation of the invention, more fully described hereinafter.

FIG. 2 illustrates a receptacle's lid 21 in which spout assembly 24 is retained in a closed mode for can 20. It should be understood that the invention is applicable as well to a wall that forms a recessed pocket (29) in a receptacle proper itself, vis-a-vis a lid crimped to a can as illustrated herein. Pocket 29 is formed to a sufficient depth by wall 38 to accommodate the geometry of spout assembly 24 and the connecting appendages on body formation 27 more fully described hereinafter, whereby the disposition of spout assembly 24, etc., does not extend above the plane of the lid or wall 21 in which pocket 29 is disposed. Pocket 29 includes volumetric room at its one end to accommodate a finger or the like (not shown) that manipulates orifice 33 of spout assembly 24 from its closed mode within pocket 29 into an open position or operable mode for operation of the invention.

Figure 1A:
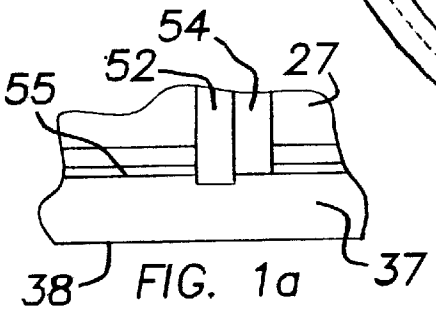
FIG. 1*a* is a fragmentary enlarged view of a portion enclosed by phantom-line P2 in FIG. 1.

Intermediate the length of channeling body formation 27, an endless peripheral flange 52, FIGS. 1*a*, 2, 3, for seating the spout assembly 24 on floor 37 in the open mode of the invention, is securely mounted to and around it. An endless lug or segment 54 depends from and throughout the peripheral length of peripheral flange 52, being spaced from the walls of body formation 27. An endless groove 55, FIGS. 1, 1*a*, 3, is formed in floor 37, for cooperating with lug 54 in the open mode of the invention, by accepting and retaining lug 54 in a tight engagement that effectively and efficaciously seals floor 37 and spout assembly 24 together so that content from the interior of can 20 is prevented from leaking through this connection as can 20 is turned over or upside down when in an operational mode. Also, such tight engagement is maintained in a turned over or upside down position for can 20.

Figure 5:
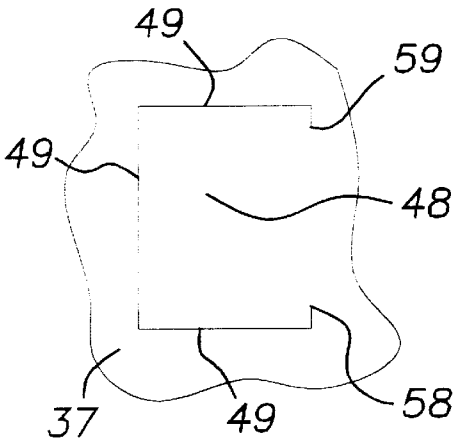
FIG. 5 is a view taken on line 5—5 of FIG. 2.
Figure 4:
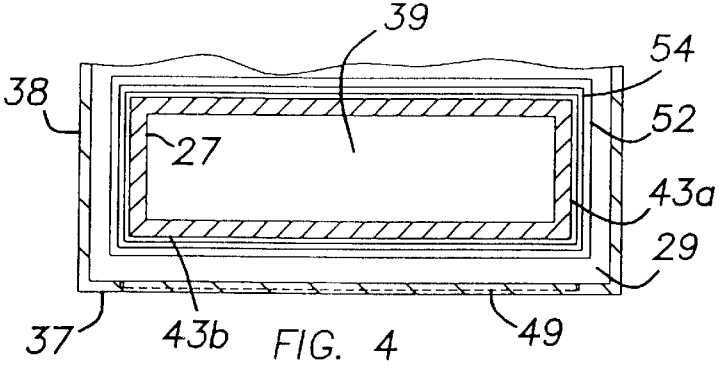
FIG. 4 is a view taken along line 4—4 of FIG. 1, just above the bottom wall of the floor for the spout assembly.
Figure 2D:
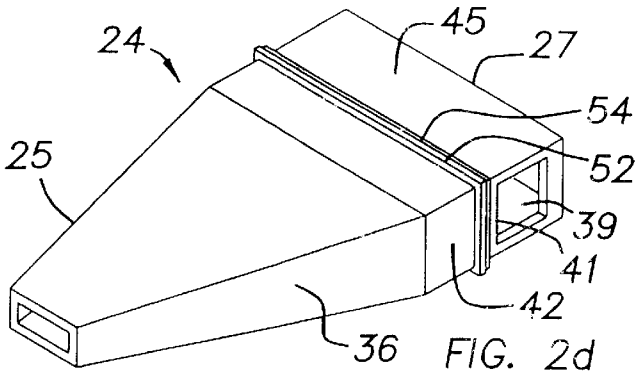
FIG. 2*d* is a perspective view of the spout assembly of this invention.
Figure 2B:
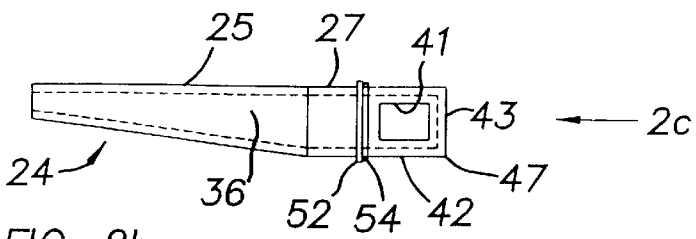
FIG. 2*b* is a side elevational view of the spout assembly of the invention.
Figure 2C:
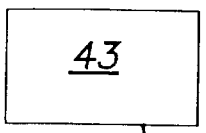
FIG. 2*c* is a view taken in the direction of the arrow 2*c* of FIG. 2*b*.

The non-endless scored band or line 49, FIG. 5, in floor 37 of pocket 29 generally matches the boundary of the areal dimensions of bottom wall 43, these dimensions being illustrated in FIG. 4 by 43*a*, 43*b*, of channeling body formation 27. As illustrated in FIG. 5, scored band or line 49 terminates at its ends 58, 59 which do not meet together, thereby providing floor 37 with frangible portion 48 that is retained after its breaking with its floor 37 in the operation of the invention.

Within floor 37 at a point distal from body formation 27 and as illustrated in the enlarged FIG. a, the wall 60 of floor 37 is punched as at 61, forming a small punched area 63, it becoming frangible by the nature of punching to a thinner thickness. As shown in FIG. a, an appendage, such as a flexible bendable relatively thin arm 65 adjacent its one end 66, is attached by a rivet 67 to wall 60 that forms floor 37, and also is attached by rivet 67 to a wall 69 forming the wall 70 of the one lateral side 35 of the spout proper 25. The arm 65 at its other end 71, FIG.2, is turned back on itself and is suitably attached to the floor's wall 60, FIG. 2, as by a rivet 72, at a point in the direction towards body formation 27 and at a distance from the position of rivet 67. Arm 65 is of a sufficient width and length to make it integrally sturdy in its extended position, FIG. 3. In the operation of the invention, the motion of spout assembly 24 from its storage in pocket 29 pulls with it rivet 67 and the weakened portion of floor 37 below the punched area 63, thereby forming an airhole 73, FIG. 3, through floor 37, with ingress of air to below wall 60 of floor 37, thus equalizing pressure on both sides of wall 60 of floor 37 in the open mode for the invention. End 71 of arm 65 assists the retention of spout assembly 24 in the open mode of the invention, FIG. 3, during dispensing of the can's content, to its efficacious placement or engagement in wall 60.

In operation, spout assembly 24 in the closed mode for the invention is disposed upon or over floor 37 of recessed pocket 29 of wall or lid 21, FIGS. 1, 2. A finger (not shown), or other means manually or otherwise, grasps at orifice 33 at the open end 22 of spout proper 25, pulling it away or in an upward manner from floor 37. In such pulling action, the weakened area or portion in wall 60 of floor 37 below the punched area 63 of its wall 60 is broken off and is taken along with the spout proper 25, thus forming airhole 73 and releasing or equalizing pressure inside and outside of can 20. As spout assembly 24 continues to be turned upwardly, edge 47 of body formation 27 is caused to strike and break the frangible portion 49 in wall 60 of floor 37. Body formation 27 is thrust downwardly, manually by one's hand or fingers, past wall 60 so that the depending lug or segment 54 on flange 54 can be inserted into the endless groove 55. A tight fit or engagement between spout assembly 24 and wall 60 of floor 37 results thereby providing a stabilized and fixed condition between spout assembly 24 and receptacle 20. Upon turning over can 20 from an upright position, the aperture(s) 41 are in a position for continuous channeling of content from the interior of can 20 into chamber 39 of body formation 27 and from there to the spout proper 25 and thence to its orifice 33, from which one can drink a liquid content in can 20 or pour the content out for another purpose than drinking it. The extension of arm 65 resulting from unstoring spout assembly 24 from its pocket 29 assists in maintaining it in its fixed location in the operation of the invention.

In assembling spout assembly 24 itself, it is formed by metal working of material such as sheet aluminum to form its sidewalls, score lines, frangible portions, and scored and/or recessed portions. Body formation 27 and its apertures 41 likewise are formed by metal working of sheet aluminum, either as part of the aluminum forming spout assembly 24 or separately and thereafter attached to it. Flange 52 and lug or segment 54 are formed, say, from a single piece of sheet aluminum with spout assembly 24, or connected such as by soldering onto body formation 27. Ann 65 of aluminum or other suitable material is fashioned and then its portions adjacent its ends riveted to wall 60 of floor 37 and to wall 70 of the one side 35 of spout proper 25, respectively. Thence, spout assembly 24 is stored in its pocket 29. Fabrication of these described elements is achieved by techniques in metal working of sheet aluminum such as by punching, scoring, and forming and attaching them by known processes of the art. Sheet aluminum, of course, is the preferred material for producing the disclosed article, although other suitable materials may be utilized, including plastic.

Various changes and modifications in the invention and in its uses materialize in its different applications without varying from the spirit and scope of the invention. The invention embraces other geometrical configurations for the spout proper 25 and spout assembly 24 than what is illustrated as a truncated pyramid and the box-like formation for body formation 27. The invention contemplates adaptability of spout assembly 24 to receptacles that contain content other than soft-drinks, ales, beers, bottled water, coffee, etc., such as, for example, granular and particulate material or other substances that flow, and wherever it is suitable for a spout to discharge its content from within receptacle. Peripheral flange 52 and lug 54 are placeable at the intersection with spout proper 25 as well as shown intermediate the length of the hollow body formation 27. The invention comprehends a wall or lid of a can being pierced by spout assembly 24, without a storage pocket in the can to receive the spout assembly, whether an arm 65 is applied or not. Pocket 29 can be designed in dimension other than the drawing illustration showing the spout proper 25 being lifted up by pulling on the spout at its orifice 33. For example, say, the pocket's dimensions can be wide enough so that by side(s) 36 the spout proper 25 can be grasped and lifted out. Without arm 65 being included, rivet 67 can be used to generate airhole 73.

INDUSTRIAL APPLICABILITY

The invention is applicable to the can industry which produces cans for containing flowable content of various sorts, and is not limited to the soft drink and other liquid or beverage industries.

I claim:

1. The combination of a spout assembly and a receptacle having a lid and an interior from which its content can be discharged into the spout assembly in an open mode for the receptacle comprising a storage pocket formed in said lid, said pocket having a floor sufficiently deep for depositing in a closed mode for said receptacle said spout assembly, said floor having scored means forming a frangible portion therein, said spout assembly including a spout proper terminating at an orifice for dispensing the receptacle's content and body formation means below said spout proper including side wall means forming a chamber, an aperture in said side wall means for channeling the content from the receptacle into the chamber and thence to said spout proper, and solid bottom wall means connected to said side wall means, means for seating said spout assembly on said floor in an open mode for the receptacle, and means for breaking said frangible portion upon shifting said spout assembly from its closed mode in said pocket into the open mode for the receptacle.

2. The combination of claim 1 wherein said seating means comprises an endless flange formed on said body formation means.

3. The combination of claim 1 or claim 2 including means for preventing leakage of content between said spout assembly and said floor in the open mode for the receptacle.

4. The combination of claim 3 wherein said preventing means comprises an endless lug depending from said endless flange and an endless groove formed in said floor, said lug and groove tightly mating with one another in the open mode for the receptacle.

5. The combination of claim 4 wherein said body formation means includes an edge, said breaking means comprising said edge which strikes the frangible portion upon such shifting to break it from said floor.

6. The combination of claim 5 including means for forming an airhole in said floor upon such shifting.

7. The combination of claim 6 wherein said forming means comprises a rivet connecting together said spout proper and said floor whereby said rivet is pulled in the shifting of said spout assembly to the open mode for said receptacle.

8. The combination of claim 7 including means for assisting the maintenance of said spout assembly to said receptacle in its open mode.

9. The combination of claim 8 wherein said assisting means is an arm having ends, said rivet and a second rivet respectively connecting said arm proximate to its ends to said floor and to said spout proper.

10. The combination of claim 1 wherein said side wall means and said solid bottom wall means form an edge constituting said breaking means.

11. A spout assembly for dispensing content from a receptacle's interior through an orifice at the one end of a spout proper in said spout assembly and comprising, an endless wall forming a hollow member terminating at the orifice in said spout proper, body formation means including a chamber connected to said spout proper at a distal end to its orifice, said body formation means including side wall means, an aperture in said side wall means for channeling the content from the receptacle into the chamber and thence to said spout proper, and solid bottom wall means connected to said side wall means, first means mounted on said body formation means for breaking a portion of a wall of a receptacle upon assembling said spout assembly to the receptacle, second means on said body formation means for cooperating with a means in a wall of the receptacle whereby an efficacious sealing of said spout assembly to the receptacle is achieved.

12. The spout assembly of claim 11 wherein said first means comprises edge means.

13. The spout assembly of claim 12 wherein said second means comprises an endless flange formed on said side walls above said aperture and below said spout proper and an endless lug depending from said endless flange.

14. The spout assembly of claim 12 wherein said side wall means with the solid bottom wall constitutes said first means, said first means comprising edge means.

15. A receptacle having a lid, said lid including a recessed pocket formed in said lid for receiving a spout assembly for storage thereof prior to lifting the spout assembly therefrom into an open mode for dispensing content from the receptacle, said recessed pocket having a floor, a frangible portion formed in said floor breakable upon a forcing element on the spout assembly assembled to the lid of the receptacle striking it, and endless groove means formed in said floor separated from said frangible portion for effecting an efficacious seal between said lid and the spout assembly in the open mode for the receptacle upon said endless groove means accepting and retaining a cooperating means on the spout assembly.

16. The receptacle of claim 15 in combination with the spout assembly having a spout proper, and wherein said cooperating means comprises lug means depending from flange means formed on a body formation means in said spout assembly, said body formation means formed below said spout proper and including side wall means forming a chamber, an aperture in said side wall means for channeling the content from the receptacle into the chamber and thence to said spout proper, and solid bottom wall means connected to said side wall means.

* * * * *